US007484633B1

(12) United States Patent
Moher

(10) Patent No.: US 7,484,633 B1
(45) Date of Patent: Feb. 3, 2009

(54) CONTAINER SYSTEM FOR THE STORAGE AND MIXING OF STORED INGREDIENTS

(76) Inventor: Laura E. Moher, 201 Reilly Rd., Wyoming, OH (US) 45215

( * ) Notice: Subject to any disclaimer, the term of this patent is extended or adjusted under 35 U.S.C. 154(b) by 176 days.

(21) Appl. No.: 11/388,587

(22) Filed: Mar. 24, 2006

Related U.S. Application Data

(60) Provisional application No. 60/665,242, filed on Mar. 25, 2005.

(51) Int. Cl.
*A61J 9/00* (2006.01)
*A61J 11/04* (2006.01)
*B65D 1/04* (2006.01)

(52) U.S. Cl. ..... 215/11.1; 215/6; 215/277; 215/DIG. 8; 206/219; 220/521; 426/117

(58) Field of Classification Search ..... 215/6, 215/10, 11.1, DIG. 8, 277; 206/219, 221, 206/222; 426/115, 117, 11; 220/521; 222/145.5
See application file for complete search history.

(56) References Cited

U.S. PATENT DOCUMENTS 2,168,179 A * 8/1939 Tobey ..... 401/202
2,793,776 A * 5/1957 Lipari ..... 206/221
2,836,321 A * 5/1958 Soltesz et al. ..... 215/11.1
4,703,863 A * 11/1987 Kohus ..... 215/11.1
4,979,629 A * 12/1990 Askerneese ..... 215/11.1
5,112,628 A * 5/1992 Conrad ..... 426/117
5,114,011 A * 5/1992 Robbins, III ..... 206/499
5,275,298 A * 1/1994 Holley et al. ..... 215/11.4
5,307,847 A * 5/1994 Pavenick et al. ..... 141/20.5
5,345,981 A * 9/1994 Pavenick et al. ..... 141/20.5
5,361,918 A * 11/1994 Mason ..... 215/6
5,634,714 A 6/1997 Guild
5,794,802 A 8/1998 Caola
6,174,099 B1 * 1/2001 Patel et al. ..... 401/129
6,257,428 B1 7/2001 Caola
2005/0056608 A1 * 3/2005 Nesin ..... 215/11.1

* cited by examiner

*Primary Examiner*—Sue A Weaver
(74) *Attorney, Agent, or Firm*—Gregory J. Nelson

(57) ABSTRACT

A fluid dispensing and mixing system for use with a container such as a baby bottle. A cap having a chamber containing dry contents may be placed in threaded engagement with the bottle in a first storage position. The baby bottle is filled with fluid. At the time of use, the cap is removed and inverted and placed in threaded engagement with the bottle. In this position, the fluid contents of the bottle and the dry contents in the dry chamber may be intermixed.

7 Claims, 3 Drawing Sheets

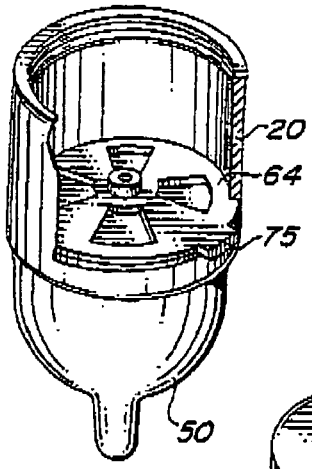
Fig. 4A
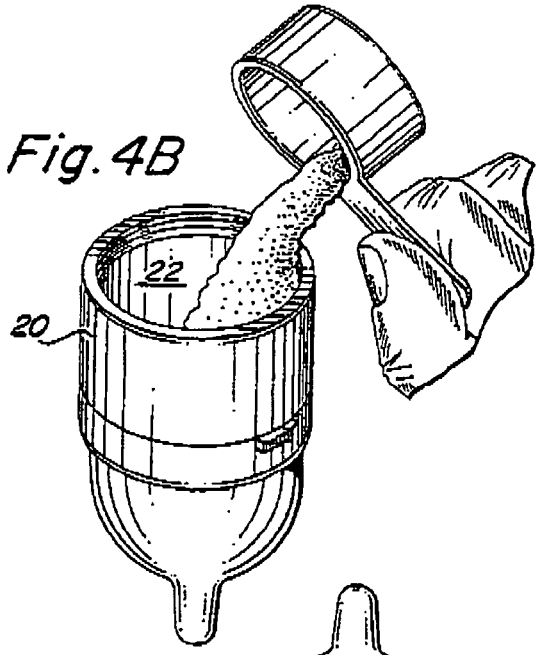
Fig. 4B
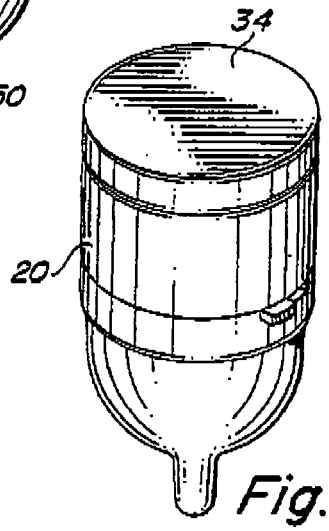
Fig. 4C
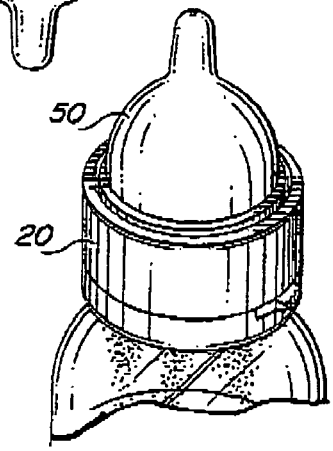
Fig. 4F
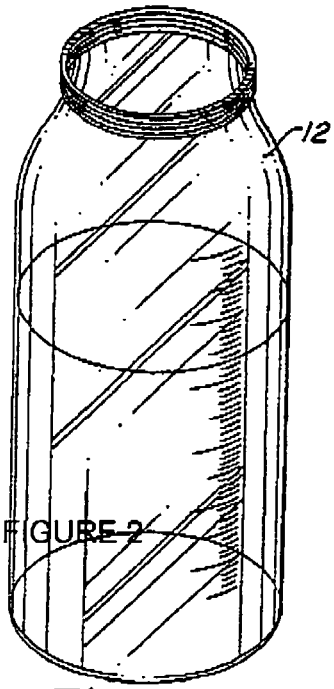
FIGURE 2
Fig. 4D
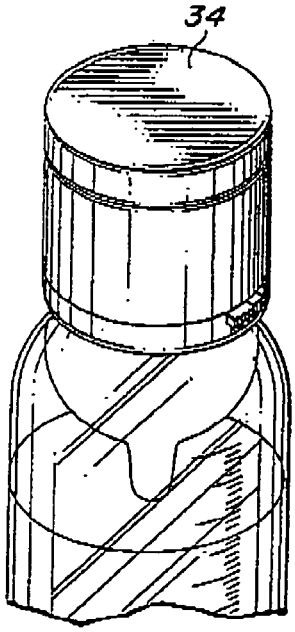
Fig. 4E
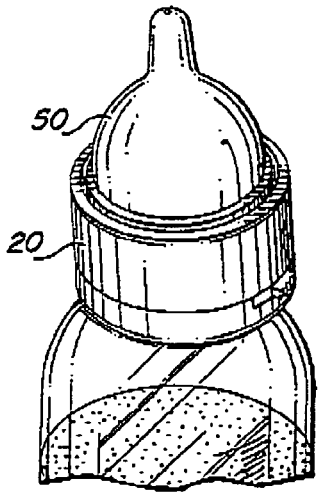
Fig. 4G

CONTAINER SYSTEM FOR THE STORAGE AND MIXING OF STORED INGREDIENTS

CROSS REFERENCE TO RELATED APPLICATION IS MADE

This application is based on U.S. Provisional Patent Application Ser. No. 60/665,242, filed Mar. 25, 2005, of the same title.

FIELD OF THE INVENTION

The present invention relates to a container and more particularly relates to a container for separately storing the ingredients until the time of use of commonly mixed.

BACKGROUND OF THE INVENTION

Many parents feed their infants dry, powered baby formula. At the time of use, it is necessary to mix the formula with water to produce a liquid which is consumed by infants using a baby bottle with a nipple. Once the dry formula and the water is mixed is must be consumed within a short period of time or must be refrigerated to avoid spoilage.

Therefore, parents and attendants can premix the formula with fluid in a baby bottle only if it is to be used within a short period of time. However, on many occasions parents and children may be away from a refrigerator or cooler for a long period of time and in this situation it is not safe to use premixed formula. Maintaining the mixed formula in a refrigerated or cool condition in an ice chest or other cooling device is not always practical.

Accordingly, many parents will carry a tote bag of some type in which various items for the care and feeding of the baby are contained, as for example diapers, toys, medications, dry formula and water.

When the infant is to be fed, the parent or attendant will open the container of dry formula and open a separate container of water. A quantity of water will be poured into the baby bottle and the dry formula measured using a measuring spoon in accordance with the manufacturer's recommendations. Once the formula and water are in the container, the cap and nipple are screwed onto the container and the container shaken until the contents are thoroughly mixed. This procedure can be cumbersome and require the parent or attendant to carry a supply of water and formula.

Accordingly, there exists a need for an infant feeding bottle which will separately store, mix and dispense the materials at the time of use.

In recognition of this problem, various devices or containers can be found in the prior art. For example, U.S. Pat. No. 6,257,428 shows a reusable insert designed for off-the-shelf covered containers, such as an infant feeding bottle, having a storage compartment for powdered formula, a top opening to the compartment, a bottom opening to the compartment, a closure for closing the bottom portion and an actuator that is guided for vertical movement within the housing for operative engagement with the closure. The upper end of the actuator extends below the nipple which is attached to the infant feeding bottle so the user can apply downward pressure on the actuator to cause the closure to move from the closed position to an open position releasing the powder formula into the infant feeding bottle.

Other somewhat similar devices are found in U.S. Pat. Nos. 5,794,802 and 5,634,714. These latter patents, as well as the '428 patent, are somewhat complex, difficult to clean and utilize a push rod to release formula from the upper chamber into the lower chamber in which the push rod is actuated by applying force to the nipple.

Accordingly, there exists a need for a storage, mixing and dispensing device for mixing a powder and fluids such as baby formula and water which will maintain the components separate until the time of use.

Further there exists the need for a device of this type which is easy to use, which has minimum components and is adaptable for use with most conventional infant feeding bottles in use today.

BRIEF SUMMARY OF THE INVENTION

Briefly, in accordance with the present invention, a fluid dispensing and mixing system is provided for use with a conventional baby bottle of the type having an opening with a threaded top. A dry chamber may be placed in threaded engagement with the top of the bottle. In the storage position, the nipple is disposed downwardly and an isolation valve separates the interior of the nipple from the dry chamber. The dry chamber may be pre-filled with powder such as infant formula and the bottle or container may be filled with a fluid such as water. Once the bottle and the dry chamber have been filled to the appropriate levels, a cap or closure may be placed on the top of the dry chamber. In this position, the device may be carried by the parent or attendant and the components are separated until time of use. At the time of use, the cap is removed and the nipple and dry chamber removed and inverted and screwed onto the top of the baby bottle. The isolation valve may then be opened to release the dry formula into the fluid and the contents shaken and ready for use.

In an alternate embodiment, an isolation valve is provided at both the top and bottom of the dry chamber so that when the dry chamber is removed from the storage position and inverted, the dry contents will not spill from the dry chamber. Both valves are opened once the dry chamber has been repositioned in the use position on the top of the bottle which allows the contents of the dry chamber and the liquid in the bottle to be mixed.

BRIEF DESCRIPTION OF THE DRAWINGS

The above and other objects and advantages of the present invention will be more fully understood from the following description, claims and drawings in which:

FIGS. 4A to 4G illustrate the sequential steps in use of the mixing and dispensing system of the invention;

DETAILED DESCRIPTION OF THE DRAWINGS

Figure 1:
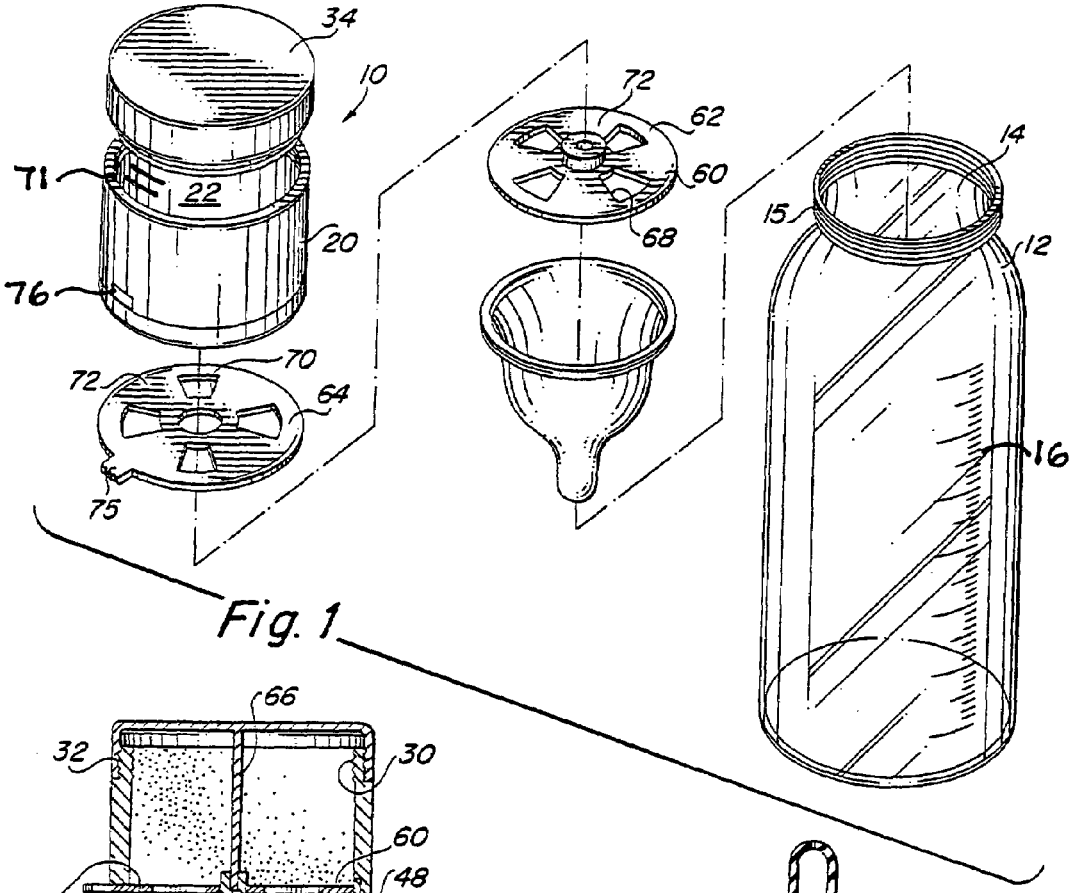
FIG. 1 is an exploded perspective view showing an embodiment of the fluid mixing and dispensing system of the present invention.

Turning now to the drawings, FIGS. 1 through 4 illustrate an embodiment of the invention generally designated by the numeral 10. The fluid mixing and dispensing system is for use with a conventional container 12 of the type commonly used to dispense formula to a baby. The containers 12 are generally a clear plastic or glass having an opening 14 at their upper end with a threaded collar 15 extending around the opening. The bottle may be provided with graduations 16 for the convenience of the user.

The dispensing system 10 of the present invention includes a housing 20 which is shown as generally cylindrical which defines an internal dry chamber 22. One end of the chamber defines an annular recess 24 which is internally threaded at 26. Threads 26 are engageable with threads 15 on the top of the container 12. The opposite end of the housing is also provided with threads 30 on the inner surface which are also selected to engage with threads 15 on the top of the bottle.

The exterior of the housing 20 has a threaded section 32 which is engageable with a closure or cap 34. One end of the housing defines an opening or aperture 42 which is sized to receive a nipple 50. As is conventional, the flange of the nipple will seat on edge 52. The nipple may be held in place by a removable snap ring 54. The snap ring 54 is annular and will allow the nipple to be removed if necessary. The housing 20 may be disassembled at threaded connection 48 to access the nipple for cleaning and replacement.

An isolation valve 60 is disposed in the housing inwardly of end 40. The valve 60 consists of a first disc plate 62 and second disc plate 64 which are rotatable relative to one another on shaft or spindle 66. Each of the discs defines radially extending apertures 68 and 70, respectively. The apertures are spaced-apart so that land area 72 exists between the apertures. Disc plate 64 has a lever 75 which projects through a small opening 76 in the side of the dry chamber. The opening 76 contains a resilient seal such as a silicone rubber to prevent leakage. Rotation of disc plate 64 relative to disc 62 to place land 72 of disc 64 in alignment with the apertures 70 will close the dry chamber so that powder therein will not be released from the chamber. When the upper disc is rotated to the open position, the apertures 68 and 70 are in alignment allowing the dry chamber to be in communication with the nipple. Thus, in the closed position, the dry formula will not be allowed to enter the nipple to prevent possible clogging.

Figure 2:
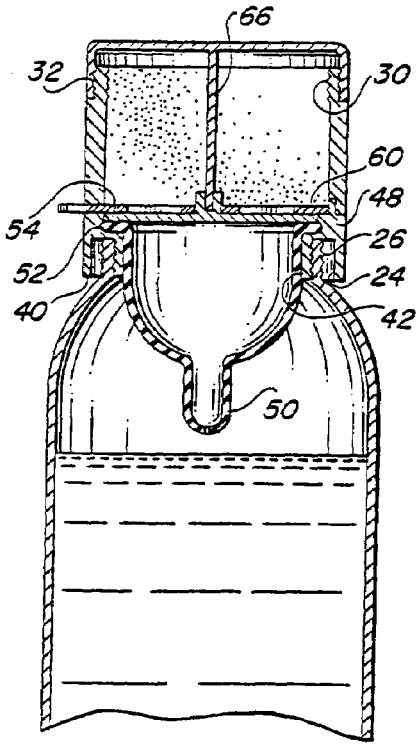
FIG. 2 is a sectional view showing the system of the present invention with the contents in their stored positions.
Figure 3:
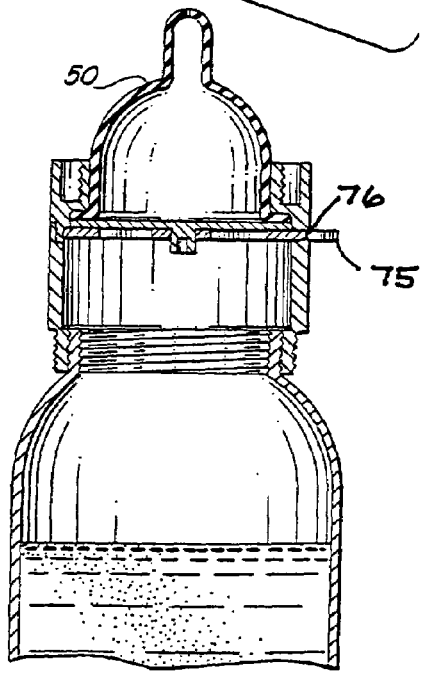
FIG. 3 is a view similar to FIG. 2 showing the dry container and nipple in the inverted use position.

FIG. 2 shows the mixing and dispensing system of the present invention in the stored position. In this position, the nipple has been inserted in a downward position through the neck or opening 40 of the housing. The housing 20 has been placed in threaded engagement with the top of the bottle at threads 15. The isolation valve 60 is in the closed position and a pre-measured amount of formula has been placed within the dry chamber. Preferably the dry chamber may include graduations 71 on the interior surface for the convenience of the user. A quantity of liquid, such as water, has been placed in the container 12. The cap 34 has been screwed on to the dry chamber. In this position, the contents are separated and the container may be stored for use at a later time. For example, one or more containers, such as shown in FIG. 2, may be carried by a parent or attendant.

At the time of use, the cap 34 is removed. The nipple and housing can be withdrawn from the neck of the container and the housing may be carefully inverted and the dry container is screwed onto threads 15 on the bottle at threads 30. Once this is accomplished, the isolation valve is opened by rotating lever 75 to the open position, which allows the dry formula t fall into the container 12. The container can then be vigorously shaken and the contents thoroughly mixed.

FIGS. 4A to 4C illustrate the sequence or steps of use.

In FIG. 4A, the dry container and nipple are shown in the inverted position and the valve is in the closed position.

In FIG. 4B, the user places a pre-measured amount of powdered formula into the interior of the dry chamber 22.

In FIG. 4C, the cap has been placed over the dry chamber.

In FIG. 4D, the bottle has been filled with a predetermined quantity of fluid.

FIG. 4E shows the dry container with the nipple in the inverted position coupled or screwed on to the top of a bottle.

FIG. 4F illustrates the use position in which the housing containing the dry chamber has been removed and inverted to the use position and coupled or screwed to the top of the container. The contents of the dry chamber are shown flowing into the fluid ready for mixing. FIG. 4G shows the contents mixed.

Figure 5:
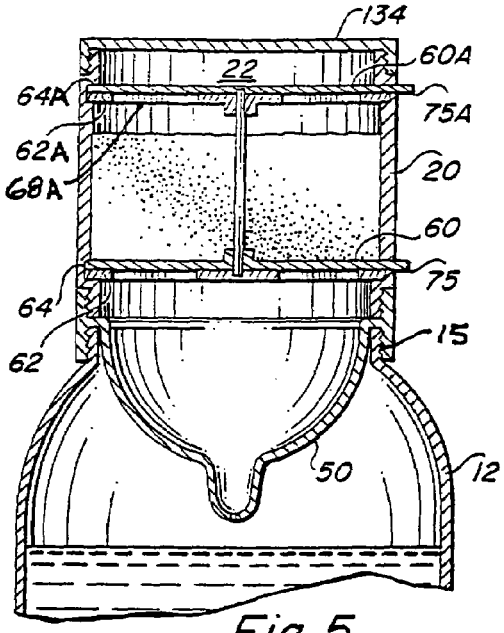
FIG. 5 is a cross-sectional view of an alternate embodiment of the present invention in which an isolation valve is provided in both the opposite ends of the dry chamber.

In FIG. 5, an alternate embodiment of the present invention is shown, again as used with a container 12 of the conventional type having a neck with external threads 15. The dry chamber 22, again, has an outer, cylindrical wall which at one end, has a threaded section which is engageable with the threads at the upper end of the bottle in the storage position. The nipple 50, again, is shown depending into the upper end of the fluid container. The opposite end of the interior of the dry chamber has threads which are also engageable with the threads 15 on the bottle. The exterior surface of the dry container is also threaded to receive a closure or cap 134.

In the embodiment shown in FIGS. 5 through 7C, the dry container is provided with a pair of isolation valves 60, 60A at opposite ends of the chamber. Each of the isolation valves are as shown and described with reference to FIG. 1. The upper valve 60A has a pair of disc plates 62A, 64A disposed adjacent one another each with apertures 68A and lands 72A. The lower isolation valve 60 has discs with apertures 68 and lands 72. The discs are relatively rotatable between an open position in which the apertures are in alignment and a closed position in which the apertures 68 in one plate align with a blocking land 72 in the other plate. One of the plates in each valve is rotatable by a lever 75 which extends through a sealed aperture in the sidewall of the dry chamber.

Figure 6:
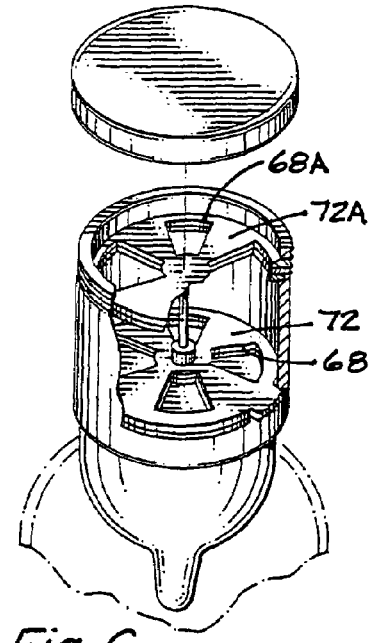
FIG. 6 is a perspective view partly broken away showing the dry chamber of FIG. 5 in the stored position on a container.

FIG. 5 illustrates the stored position. The dry chamber has been filled with a powder by placing the nipple in the inverted position in the neck of the bottle and engaging or coupling the dry chamber to the top of the bottle at the threads 15. The lower valve 60 in this position has been placed in the closed position so that the contained dry powder formula will not enter the area occupied by the nipple. The upper valve 60A is first placed in the open position, as shown in FIG. 6, so that the user may place a premeasured amount of formula into the dry chamber. Once this is accomplished, the cap 134 may be positioned over the top of the dry chamber and the upper valve closed using lever 75A.

Figure 7A:
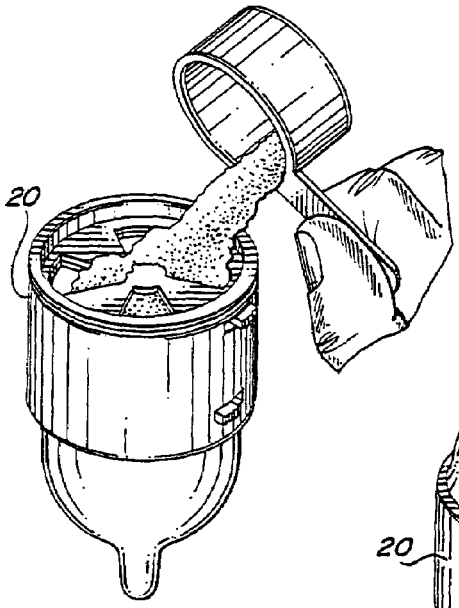
FIG. 7A is a view similar to FIG. 6 showing the user placing a powdered formula into the dry chamber.
Figure 7B:
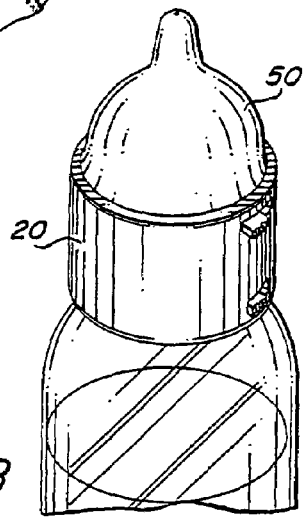
FIG. 7B illustrates the dry chamber in stored position on the top of a baby bottle.
Figure 7C:
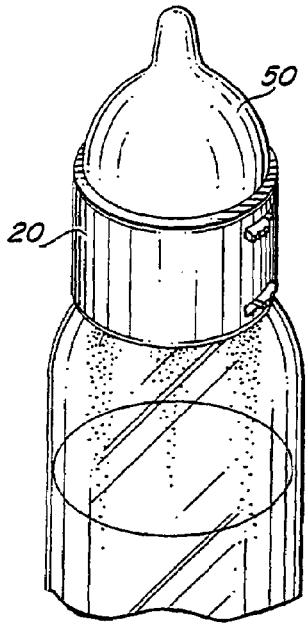
FIG. 7C shows the contents of the dry chamber being dispensed into the liquid when the opposite isolation valves are opened.

When the parent or attendant wishes to feed the infant, the dry chamber is uncoupled or unscrewed from the bottle, and the cap 134 is removed. The dry chamber may then be inverted and coupled or screwed to the top of the bottle at threads 15. Since both the upper and lower isolation valves are in the closed position, the dry powder will not be allowed to be spilled from the container during the removal, inversion and coupling of the dry chamber to the bottle in the use position. The use position is shown in FIG. 7B. Once the dry chamber has been secured to the bottle, the upper and lower valves are opened and the contents of the dry chamber will be allowed to flow into the bottle and the contents can be shaken and thoroughly mixed as seen in FIG. 7C.

From the foregoing, it will be seen that the present invention provides a simple, efficient and effective fluid mixing and dispensing system, particularly useful in connection with infant feeding bottles. The system contains a minimum of parts and will effectively separate the components until the time of use. This allows a parent or attendant to prepare a number of bottles in the manner described above and keep the bottles available until the time of use, at which time the contents can be mixed. The components can be easily cleaned and sterilized by conventional recommended means.

It will be obvious to those skilled in the art to make various changes, alterations and modifications to the invention described herein. To the extent such changes, alterations and modifications do not depart from the spirit and scope of the appended claims, they are intended to be encompassed therein.

I claim:

1. A system for separably storing and mixing a dry and a liquid ingredient comprising:

(a) a container defining a first chamber for the liquid ingredient, said container having an opening;

(b) a cap with first and second open ends defining a second chamber for the dry ingredient and having dispensing means engageable with said first open end, said first and second open ends being engageable with said container opening;

(c) an isolation valve in said cap having an open position communicating said dispensing means and said second chamber and a closed position isolating the dispensing means and said second chamber; and (d) said cap having a first position with said first open end engaging said container opening and in which the contents of the first and second chambers are separated by said dispensing means and a second position in which the cap is inverted with the second cap end engaging said opening end and said dispensing means in a dispensing position whereby the contents of said first and second chambers may be intermixed when the isolation valve is in the open position.

2. The system of claim 1 wherein said isolation valve is operable by actuation means externally located on said cap.

3. The system of claim 1 wherein said cap includes a removable closure securable to the second end of said cap when the cap is in the first position.

4. A system for separably storing a dry ingredient and a liquid ingredient comprising:

(a) a container defining a first liquid ingredient chamber, said container having a threaded opening;

(b) a cap having first and second ends and defining a second dry ingredient chamber;

(c) a nipple attached to the first end of said cap, the first end of the cap having first threads engageable with said container threaded opening to secure said cap in a first position with the nipple depending into said first chamber;

(d) said cap having second threads at said second end securable to said container threaded opening with said cap in a second position and with the nipple in a position of use;

(e) a removable closure engageable with the second end of the cap when said cap is in said first position; and (f) whereby the contents of said first and second chambers are isolated when said cap is in said first position and the contents of said first and second chambers may be intermixed when said cap is in said second position.

5. The system of claim 4 wherein an isolation valve is located in said cap adjacent said first end to control the discharge of dry contents from said second chamber.

6. The system of claim 4 wherein the container is a baby bottle.

7. The system of claim 6 wherein the bottle is a generally transparent plastic having graduations thereon.

* * * * *